US009518536B2

(12) United States Patent
Sekiya et al.

(10) Patent No.: US 9,518,536 B2
(45) Date of Patent: Dec. 13, 2016

(54) EXHAUST GAS RECIRCULATION DEVICE FOR INTERNAL COMBUSTION ENGINE

(71) Applicant: HONDA MOTOR CO., LTD., Tokyo (JP)

(72) Inventors: Noritaka Sekiya, Wako (JP); Yusaku Komaki, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 162 days.

(21) Appl. No.: 14/347,300

(22) PCT Filed: Oct. 3, 2012

(86) PCT No.: PCT/JP2012/075634

§ 371 (c)(1),
(2) Date: Mar. 26, 2014

(87) PCT Pub. No.: WO2013/054711

PCT Pub. Date: Apr. 18, 2013

(65) Prior Publication Data

US 2014/0318511 A1 Oct. 30, 2014

(30) Foreign Application Priority Data

Oct. 12, 2011 (JP) ..... 2011-225123

(51) Int. Cl.
*F02M 25/07* (2006.01)
*F02P 5/00* (2006.01)
*F01N 13/08* (2010.01)

(52) U.S. Cl.
CPC ..... *F02M 25/07* (2013.01); *F01N 13/08* (2013.01); *F02M 26/12* (2016.02); *F02M 26/13* (2016.02); *F02M 26/15* (2016.02); *F02M 26/28* (2016.02)

(58) Field of Classification Search
CPC F02M 25/07; F02M 25/0737; F02M 25/0707; F02M 25/074; F02M 35/10222; F02B 3/06
(Continued)

(56) References Cited

U.S. PATENT DOCUMENTS 4,231,331 A * 11/1980 Suzuki ..... F02P 5/15 123/406.48
2005/0061295 A1* 3/2005 Minato ..... F02B 1/12 123/406.45

FOREIGN PATENT DOCUMENTS

JP 2001-073760 A 3/2001
JP 2001073760 * 3/2001
(Continued)

OTHER PUBLICATIONS

International Search Report dated Dec. 25, 2012 corresponding to International Patent Application No. PCT/JP32012/075634 and English translation thereof.

*Primary Examiner* — Lindsay Low
*Assistant Examiner* — Syed O Hasan
(74) *Attorney, Agent, or Firm* — Squire Patton Boggs (US) LLP

(57) ABSTRACT

Provided is an exhaust gas recirculation device for an internal combustion engine, the device being configured, without an increase in the number of parts, so that stress concentrated on an EGR pipe and on the connection section thereof is dispersed. The upstream EGR pipe extends substantially upward from the first connection section and has four bends provided between the first connection section and the second connection section. Among the four bends, the smallest-angle bend having the smallest bend angle is disposed at a position having a substantially equal distance from both the first connection section and the second connection section.

7 Claims, 5 Drawing Sheets

(58) Field of Classification Search
USPC ..... 123/568.11–568.32, 406.48
See application file for complete search history.

(56) References Cited

FOREIGN PATENT DOCUMENTS

| | | | | |
|---|---|---|---|---|
| JP | 2003-293864 | A | | 10/2003 |
| JP | 2009-068377 | A | | 4/2009 |
| JP | 2011-038467 | A | | 2/2011 |
| JP | 2011038467 | | * | 2/2011 |

* cited by examiner

COMPARATIVE EXAMPLE

EXAMPLE

EXHAUST GAS RECIRCULATION DEVICE FOR INTERNAL COMBUSTION ENGINE

TECHNICAL FIELD

The present invention relates to an exhaust gas recirculation device for an internal combustion engine. In detail, it relates to an exhaust gas recirculation device for an internal combustion engine that causes the stress concentration acting on an EGR pipe and connection parts thereof to be dispersed by the EGR pipe, which is provided with curved parts.

BACKGROUND ART

Thus far, a technology has been disclosed that provides, in an exhaust gas recirculation device for an internal combustion engine, a bellows part to a portion of the EGR pipe in order to mitigate the stress concentration, etc. due to thermal expansion of the EGR pipe and thus increase durability, and in addition thereto, provides a clamp (stay) that suppresses vibration of the EGR pipe caused by providing the bellows part (for example, refer to Patent Document 1). It is stated that durability can be improved by this technology of Patent Document 1.

[Patent Document 1] Japanese Unexamined Patent Application, Publication No. 2011-38467

DISCLOSURE OF THE INVENTION

Problems to be Solved by the Invention

However, according to the above-mentioned technology of Patent Document 1, the number of components increases due to providing the bellows part and clamp, and thus an increase in the production requirements of the exhaust gas recirculation device for the internal combustion engine, increase in costs and increase in weight have occurred.

The present invention takes the above-mentioned issues into account, and has an object of providing an exhaust gas recirculation device for an internal combustion engine that allows the stress concentration acting on the EGR pipe and connection parts thereof to be dispersed, without increasing the number of components.

Means for Solving the Problems

According to a first aspect, an exhaust gas recirculation device (for example, the EGR device 8 described later) for an internal combustion engine (for example, the internal combustion engine 1 described later), including an EGR pipe (for example, the upstream-side EGR pipe 10) for recirculating exhaust gas to an intake channel from an exhaust channel immediately after an exhaust gas purification device (for example, the catalytic converter 5 described later) provided midstream of the exhaust channel in the vicinity of a cylinder block (for example, the cylinder block 3*b* described later) of the internal combustion engine, in which a first connection part (for example, the first connection part 10*a* described later) that connects the exhaust channel immediately after the exhaust gas purification device and the EGR pipe is provided to an upstream side of the EGR pipe; a second connection part (for example, the second connection part 10*b* described later) that connects the EGR pipe with a device (for example, the EGR cooler 11 described later) or another pipe leading to the intake channel is provided above the first connection part to a downstream side of the EGR pipe; the EGR pipe extends substantially upwards from the first connection part or extends in a substantially horizontal direction at a side of the second connection part, and has a plurality of curved parts (for example, the curved parts 10*d*, 10*f*, 10*g* and 10*h* described later) between the first connection part and the second connection part; and a narrowest-angle curved part (for example, the narrowest-angle curved part 10*d* described later) that is curved at the narrowest angle among the plurality of curved parts is disposed at a position at which a distance from the first connection part and a distance from the second connection part are substantially equal.

For example, if the exhaust gas purification device such as a three-way catalyst or DPF expands longitudinally due to heat input, a stress concentration arises in the EGR pipe connected by the first connection part with the exhaust channel immediately after the exhaust gas purification device in the first connection part and second connection part. According to the invention of the first aspect, since the narrowest-angle curved part is arranged at a position at which the distance from the first connection part and the distance from the second connection part are almost equivalent, even if making the narrowest angle at a position farthest from the first connection part and second connection part and it is an upstream-side EGR pipe made from metal, the curve angle of the narrowest-angle curved part is easily altered to easily disperse the stress concentration. The stress concentration arising at the first connection part and at the second connection part is thereby greatly dispersed by the narrowest-angle curved part, and further, the stress concentration that has not been dispersed by the narrowest-angle curved part is dispersed by the plurality of curved parts other than the narrowest-angle curved part. Therefore, with a simple configuration like providing the plurality of curved parts in the EGR pipe, it is possible to cause the stress concentration acting on the EGR pipe and the connection parts thereof to be dispersed without increasing the number of components. For this reason, an increase in the production requirements, increase in costs and increase in weight of the exhaust gas recirculation device for an internal combustion engine caused by the number of components increasing such as the conventional technology will not occur.

According to a second aspect, in the exhaust gas recirculation device for an internal combustion engine as described in the first aspect, the second connection part connects the EGR pipe and an EGR cooler (for example, the EGR cooler 11 described later) that cools EGR gas having passed through the EGR pipe; and the EGR pipe slopes downwards from the second connection part towards the first connection part.

According to the invention of the second aspect, since the EGR pipe slopes downwards from the second connection part towards the first connection part, it is possible to make discharge to the exhaust channel without condensation water produced in the EGR cooler and EGR pipe collecting in the EGR pipe.

According to a third aspect, in the exhaust gas recirculation device for an internal combustion engine as described in the first or second aspect, an extending direction of the EGR pipe from the first connection part is a substantially upwards direction from the first connection part following the exhaust gas purification device.

According to the invention of the third aspect, despite the EGR pipe approaching the exhaust gas purification device, the EGR pipe is made from metal or the like, and thus is strong to heat damage and no problems arise. It is thereby possible to achieve optimization in the layout between the EGR pipe and other devices that cannot be arranged in the vicinity of the exhaust gas purification device that are susceptible to heat damage.

According to a fourth aspect, in the exhaust gas recirculation device for an internal combustion engine as described in any one of the first to third aspects, the plurality of curved parts is arranged more between the narrowest-angle curved part and the second connection part than between the first connection part and the narrowest-angle curved part.

If the exhaust gas purification device expands in the longitudinal direction due to heat input, the EGR pipe connected at the first connection part with the exhaust channel immediately after the exhaust gas purification device is drawn to the first connection part side and the stress concentration of the second connection part becomes greatest. According to the invention of the fourth aspect, since the plurality of curved parts is arranged more between the narrowest-angle curved part and second connection part of the EGR pipe, it is possible to make the stress concentration of the second connection part at which the stress concentration reaches a maximum to be dispersed.

According to a fifth aspect, in the exhaust gas recirculation device for an internal combustion engine as described in any one of the first to fourth aspects, a curved part having a narrower angle (for example, the curved part 10*h* described later) is disposed to a side of the first connection part or a side of the second connection part, in a case of two or more of the curved parts being disposed between the narrowest-angle curved part and the first connection part or the second connection part.

If the exhaust gas purification device expands in the longitudinal direction due to heat input, a stress concentration arises in the EGR pipe connected by the first connection part with the exhaust channel immediately after the exhaust gas purification device, at the first connection part and the second connection part. According to the invention of the fifth aspect, the curved part having a narrower angle is arranged to a side of the first connection part or a side of the second connection part. For this reason, even if a pipe made from metal, the one of the curved parts having a narrower angle allows the stress concentration to be easily dispersed by varying the curve angle, and the curved part having the narrower angle is close to the first connection part or second connection part; therefore, it is possible to disperse the stress concentration of the first connection part and the second connection part.

According to a sixth aspect, in the exhaust gas recirculation device for an internal combustion engine as described in any one of the first to fourth aspects, when at least one or more of the curved parts is disposed between the narrowest-angle curved part and the first connection part or the second connection part, in a case of one being disposed, the curved part is disposed at a position at which a distance between the curved part and the narrowest-angle curved part is greater than a distance between the curved part and the first connection part or the second connection part, and in a case of two or more being disposed, the curved parts are disposed at positions at which a sum of distances between the narrowest-angle curved part and the respective curved parts is greater than a sum of distances between the first connection part or the second connection part and the respective curved parts.

If the exhaust gas purification device expands in the longitudinal direction due to heat input, a stress concentration arises in the EGR pipe connected by the first connection part with the exhaust channel immediately after the exhaust gas purification device, at the first connection part and the second connection part. According to the invention of the sixth aspect, when at least one or more of the curved parts is disposed between the narrowest-angle curved part and the first connection part or the second connection part, in a case of one being disposed, the curved part is disposed at a position at which a distance between the curved part and the narrowest-angle curved part is greater than a distance between the curved part and the first connection part or the second connection part, and in a case of two or more being disposed, the curved parts are disposed at positions at which a sum of distances between the narrowest-angle curved part and the respective curved parts is greater than a sum of distances between the first connection part or the second connection part and the respective curved parts. In other words, the curved parts are arranged to be near the first connection part side or the second connection part side. For this reason, the curved parts being arranged to the first connection part side or second connection part side better disperse a stress concentration near the stress concentration location; therefore, it is possible to disperse a stress concentration arising at the first connection part and at the second connection part.

Effects of the Invention

According to the present invention, it is possible to provide an exhaust gas recirculation device for an internal combustion engine that allows the stress concentration acting on the EGR pipe and connection parts thereof to be dispersed without increasing the number of components.

EXPLANATION OF REFERENCE NUMERALS

Figure 1:
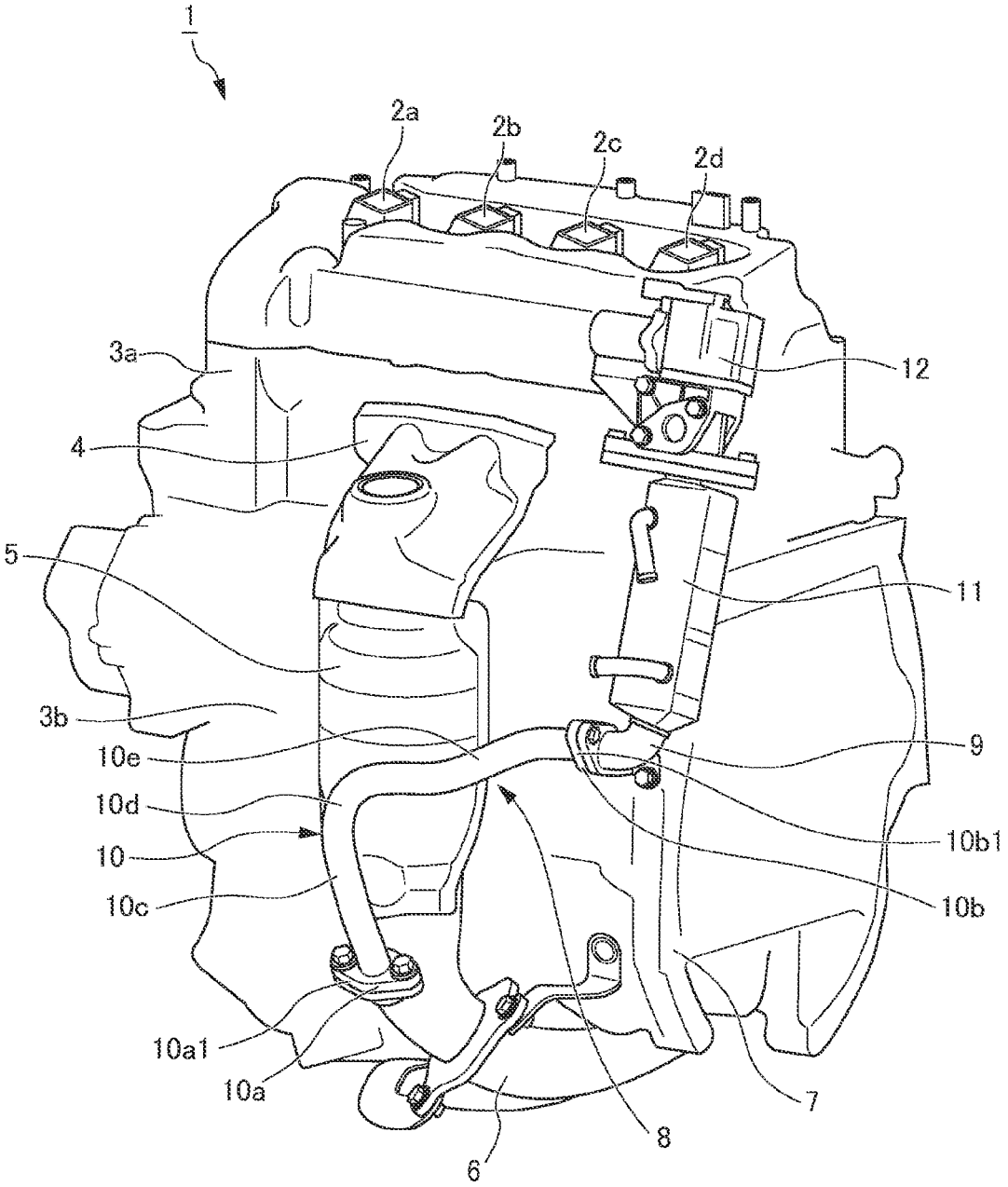
FIG. 1 is a perspective view showing a general configuration of an EGR device according to an embodiment of the present invention.

1 internal combustion engine
2*a*~2*d* cylinder
3*a* cylinder head
3*b* cylinder block
4 exhaust chamber
5 catalytic converter
6 exhaust channel downstream from catalytic converter
7 oil pan
8 EGR device
9 EGR channel
10 upstream-side EGR pipe
10*a* first connection part
10*a*1 first flange
10*b* second connection part
10*b*1 second flange
10*c* longitudinal part
10*d* narrowest-angle curved part

10*e* lateral part
10*f*, 10*g*, 10*h* curved part
11 EGR cooler
12 EGR valve
13 downstream-side EGR passage

PREFERRED MODE FOR CARRYING OUT THE INVENTION

Hereinafter, an EGR device, which is an exhaust gas recirculation device for an internal combustion engine according to an embodiment of the present invention, will be explained while referencing the drawings.

Figure 2B:
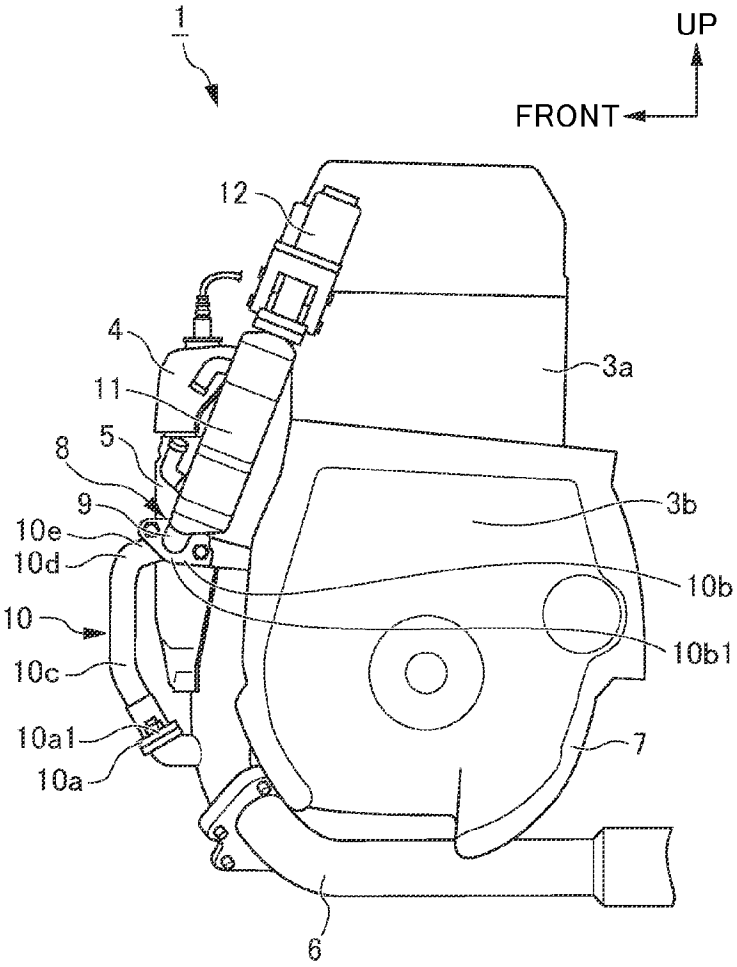
FIGS. 2A and 2B show a general configuration of the EGR device according to the embodiment, with FIG. 2A being a front view, and FIG. 2B being a side view.
Figure 2A:
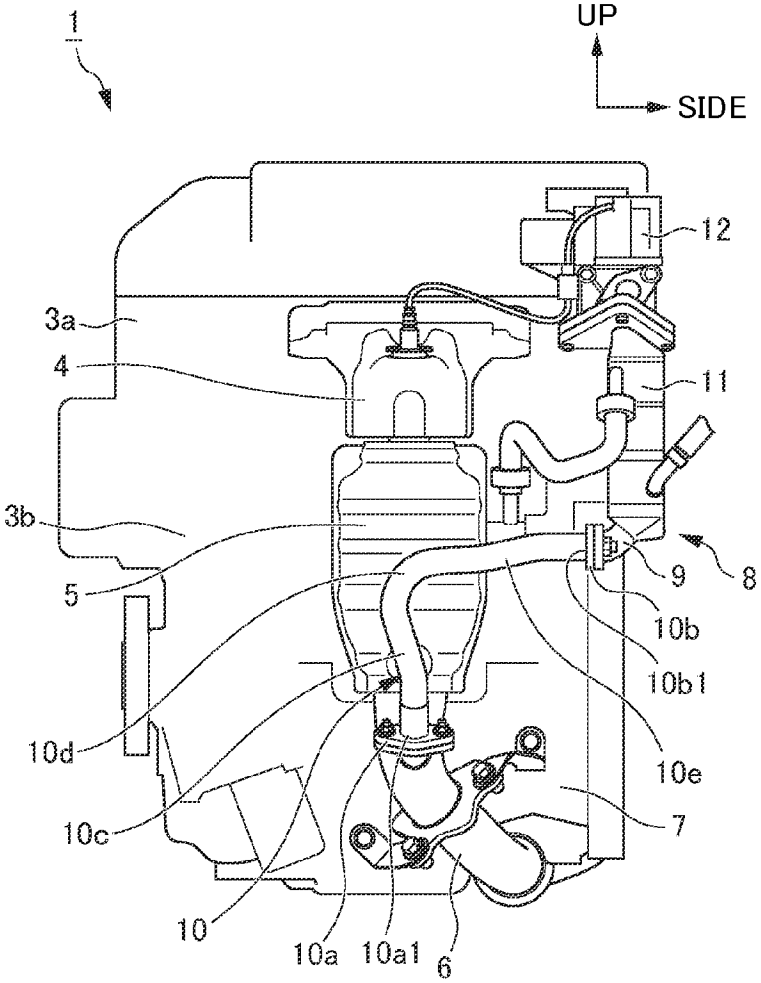
Figure 3:
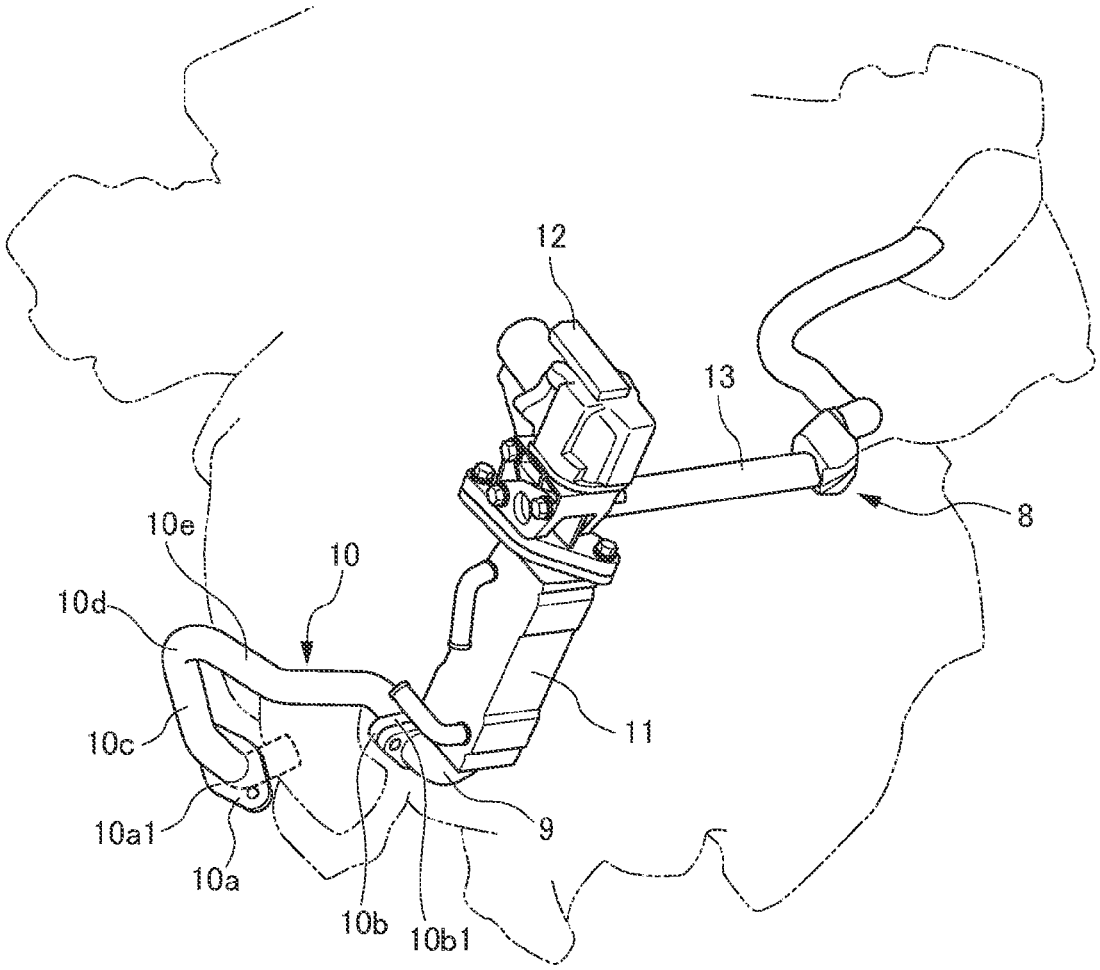
FIG. 3 is a perspective view showing the overall EGR channel of the EGR device according to the embodiment.

FIG. 1 is a perspective view showing a general configuration of an EGR device 8 according to the present embodiment. FIGS. 2A and 2B show a general configuration of the EGR device 8 according to the present embodiment, with FIG. 2A being a front view and FIG. 2B being a side view. FIG. 3 is a perspective view showing an overall EGR channel 9 of the EGR device 8 according to the present embodiment.

An internal combustion engine 1 shown in FIGS. 1, 2A and 2B is a gasoline internal combustion engine having four cylinders 2*a* to 2*d*. The internal combustion engine 1 performs combustion by being supplied intake air flowing in from an intake channel, fuel further being injected to this intake air, whereby an air/fuel mixture is formed, and the air/fuel mixture being ignited inside the cylinders 2*a* to 2*d*, and exhaust gas discharged from the internal combustion engine 1 is made to flow to an exhaust channel.

In the internal combustion engine 1, the intake channel and exhaust channel are connected to a cylinder head 3*a* of this internal combustion engine 1. Although not illustrated, the intake channel includes an intake manifold at a connection part with the internal combustion engine 1. On the other hand, the exhaust channel includes an exhaust manifold built into the cylinder head 3*a* of the internal combustion engine 1 and an exhaust chamber 4 that is an outlet channel from the cylinder head 3*a*, as shown in FIGS. 1, 2A and 2B.

A catalytic converter 5 that purifies the exhaust gas is arranged in the exhaust channel immediately downstream of the exhaust chamber 4. A three-way catalyst is mounted in the catalytic converter 5, and purifies by simultaneously oxidizing or reducing carbon monoxide, hydrocarbons and nitrogen oxides in the exhaust gas. The catalytic converter 5 is equipped midstream of the exhaust channel which extends straight downwards in the vicinity of a cylinder block 3*b* that is directly below the cylinder head 3*a* of the internal combustion engine 1 as shown in FIGS. 1, 2A, and 2B, and the axis-line direction serving as a longitudinal direction of the catalytic converter 5 corresponds to the vertical direction.

The exhaust channel 6 that is downstream of the catalytic converter 5 goes around a lower region of an oil pan 7 of the internal combustion engine 1 and is extended to the rear side of the internal combustion engine 1, as shown in FIG. 2B.

The EGR device 8 causing a portion of the exhaust gas discharged from the internal combustion engine 1 to recirculate from the intake manifold of the intake channel to the internal combustion engine 1 as EGR gas is provided to this internal combustion engine 1.

The EGR device 8 has an EGR channel 9 connected from the exhaust channel immediately after the catalytic converter 5 to the intake manifold of the intake channel, as shown in FIG. 3.

The EGR channel 9 is configured from an upstream-side EGR pipe 10 that draws in a portion of the exhaust gas from the exhaust channel immediately after the catalytic converter 5 as EGR gas; an EGR cooler 11 connected to the upstream-side EGR pipe 10; an EGR valve 12 arranged above the EGR cooler 11; and a downstream-side EGR passage 13 passing through a cylinder head 3*a* side face of the internal combustion engine 1 to connect from the EGR valve 12 to the intake manifold.

It should be noted that the EGR channel 9 has a channel cross-sectional shape that varies depending on each configuration; however, it is provided so as to substantially maintain a predetermined internal diameter.

The upstream-side EGR pipe 10 is made from metal, is connected to the exhaust channel immediately after the catalytic converter 5, and overlaps the front face of the catalytic converter 5 to stretch upwards in the axis-line direction of the catalytic converter 5, bends greatly to the right side midway, and then is connected to the EGR cooler 11. The details of the upstream-side EGR pipe 10 will be described later.

The EGR cooler 11 cools the EGR gas having flowed through the upstream-side EGR pipe 10 by exchanging heat between the EGR gas and engine coolant of the internal combustion engine 1. The EGR cooler 11 is arranged at a right-side end of the cylinder head 3*a* of the internal combustion engine 1 to make a channel portion through which EGR gas flows to turn in the vertical direction.

The EGR valve 12 adjusts the flow rate of EGR gas flowing through the EGR channel 9. The EGR valve 12 is arranged between the EGR cooler 11 and a downstream-side EGR passage 13, and is installed to the right-side end vicinity of the cylinder head 3*a* of the internal combustion engine 1 above the EGR cooler 11. The EGR valve 12 adjusts the flow rate of EGR gas flowing through the EGR channel 9 by changing the passage cross-sectional area of the EGR channel 9 according to a command of the ECU or the like.

The downstream-side EGR passage 13 is made from die-cast aluminum, and connects the EGR valve 12 and the intake manifold of the internal combustion engine 1. The downstream-side EGR passage 13 is extended from the EGR valve 12 to a side face of the cylinder head 3*a* of the internal combustion engine 1, and is connected with the intake manifold at a rear face of the internal combustion engine 1.

Next, the upstream-side EGR pipe 10 will be described in detail.

The upstream-side EGR pipe 10 is an EGR pipe made from metal that configures a portion of the EGR channel 9 recirculating the EGR gas from the exhaust channel immediately after the catalytic converter 5 to the intake manifold, as shown in FIGS. 1 and 2A. A first connection part 10*a* that connects the exhaust channel immediately after the catalytic converter 5 and the upstream-side EGR pipe 10 is provided on an upstream side of the upstream-side EGR pipe 10. A second connection part 10*b* that connects the EGR cooler 11 and the upstream-side EGR pipe 10 is provided on a downstream side of the upstream-side EGR pipe 10 above the first connection part 10*a*. In other words, the upstream-side EGR pipe 10 ties together the first connection part 10*a* and the second connection part 10*b*, which is above the first connection part 10*a*, is separated from the catalytic converter 5 more than the first connection part 10*a* and is connected with the EGR cooler 11.

To the first connection part 10*a* and second connection part 10*b* of the upstream-side EGR pipe 10, a first flange 10*a*1 and second flange 10*b*1 respectively welded thereto are provided. For this reason, the exhaust channel and the upstream-side EGR pipe 10 are joined by the first flange

10*a*1, and the upstream-side EGR pipe 10 and EGR cooler 11 are joined by the second flange 10*b*1.

The upstream-side EGR pipe 10 includes a longitudinal part 10*c* that first is extended upwards from the first connection part 10*a*, a narrowest-angle curved part 10*d* that bends greatly to the right from the longitudinal part 10*c*, and a lateral part 10*e* that is extended substantially horizontally from the narrowest-angle curved part 10*d* and connected to the EGR cooler 11, as shown in FIGS. 1, 2A and 2B. Herein, the lateral part 10*e* of the upstream-side EGR pipe 10 also slopes so that a downstream-side is positioned above the upstream-side. In other words, the upstream-side EGR pipe 10 slopes from the second connection part 10*b*, which is the outlet, downwards towards the first connection part 10*a*, which is the inlet.

In the upstream-side EGR pipe 10, the extending direction of the longitudinal part 10*c* from the first connection part 10*a* is straight up, similarly to the axis-line direction of the catalytic converter 5, and is a direction following the catalytic converter 5, as shown in FIGS. 1 and 2A. For this reason, the longitudinal part 10*c* of the upstream-side EGR pipe 10 extends upwards in parallel with the front face of the catalytic converter 5.

Herein, the upstream-side EGR pipe 10 is arranged to be separated from the catalytic converter 5 so that the first connection part 10*a* projects to the front side of the internal combustion engine 1 from the exhaust channel immediately after the catalytic converter 5 and is connected to the exhaust channel, and the longitudinal part 10*c* of the upstream-side EGR pipe 10 does not contact the catalytic converter 5, as shown in FIG. 2B.

Figure 4B:
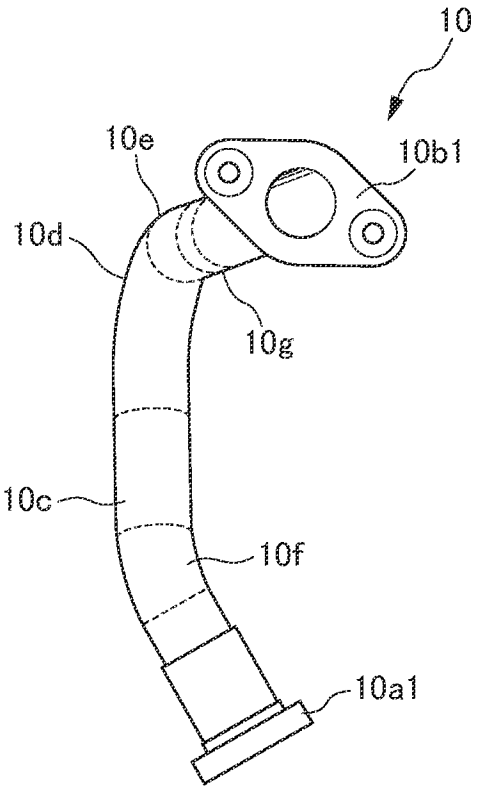
FIGS. 4A and 4B provide views showing an upstream-side EGR pipe according to the embodiment.
Figure 4A:
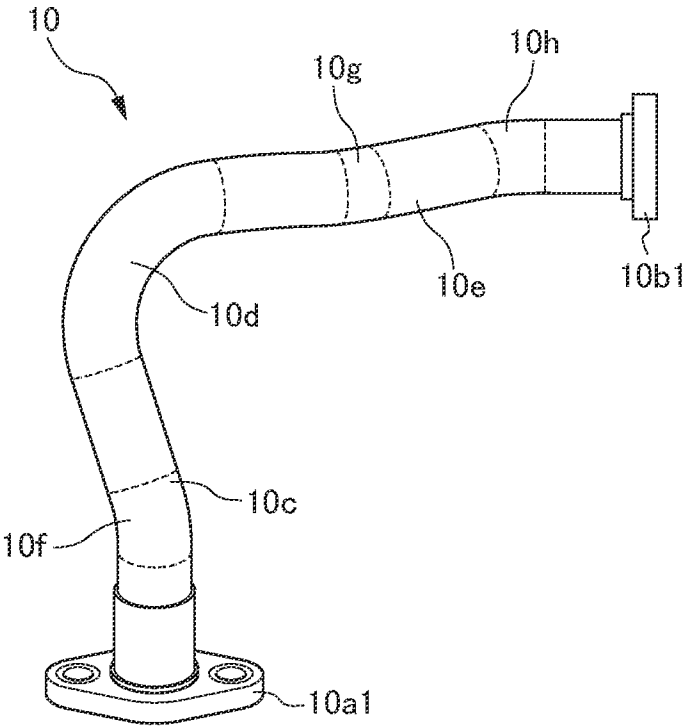

FIGS. 4A and 4B are views showing the upstream-side EGR pipe 10 according to the present embodiment.

The upstream-side EGR pipe 10 includes the longitudinal part 10*c*, narrowest-angle curved part 10*d* and lateral part 10*e*, as shown in FIGS. 4A and 4B. The lower end of the longitudinal part 10*c* connected with the exhaust channel serves as the first connection part 10*a*, and has the first flange 10*a*1 welded thereto. The end face of the first flange 10*a*1 faces downwards to an opposite side than the extending direction from the first connection part 10*a* to the longitudinal part 10*c*. The right end of the lateral part 10*e* connected with the EGR cooler 11 serves as the second connection part 10*b*, and has the second flange 10*b*1 welded thereto. The end face of the second flange 10*b*1 faces the right direction to an opposite side from the extending direction from the second connection part 10*b* to the lateral part 10*e*.

The upstream-side EGR pipe 10 includes four curved parts 10*d*, 10*f*, 10*g* and 10*h* between the first connection part 10*a* and the second connection part 10*b*, as shown in FIGS. 4A and 4B. In detail, the upstream-side EGR pipe 10 includes one of the curved part 10*f* in the longitudinal part 10*c*, includes the narrowest-angle curved part 10*d* tying together the longitudinal part 10*c* and lateral part 10*e*, and includes the two curved parts 10*g* and 10*h* in the lateral part 10*e*. In other words, the plurality of curved parts 10*d*, 10*f*, 10*g* and 10*h* are arranged more in the lateral part 10*e*, which is between the narrowest-angle curved part 10*d* and the first connection part 10*a* of the upstream-side EGR pipe 10, than the longitudinal part 10*c*, which is between the first connection part 10*a* and narrowest-angle curved part 10*d* of the upstream-side EGR pipe 10.

Then, the narrowest-angle curved part 10*d*, which is curved at the narrowest angle among the four curved parts 10*d*, 10*f*, 10*g* and 10*h*, is arranged at a position at which the distance from the first connection part 10*a* and the distance from the second connection part 10*b* are almost equal. In other words, the longitudinal part 10*c* and lateral part 10*e* of the upstream-side EGR pipe 10 have almost equivalent lengths. In the present embodiment, the ratio of length between the longitudinal part 10*c* and lateral part 10*e* is on the order of 1.2 to 1.

In addition, the curve angle of the narrowest-angle curved part 10*d* is in the vicinity of 90°. It should be noted that the curve angle of the narrowest-angle curved part 10*d* may be at least or no more than in the neighborhood of 90° and, for example, can be narrowed up to the neighborhood of 60°. The curve angle of the narrowest-angle curved part 10*d* being a limit at up to the neighborhood of 60° is because, if narrowing the curve angle more than this, a pipe made from metal will flatten greatly during shaping and problems arise in the durability.

Herein, with the present embodiment, the two curved parts 10*g* and 10*h* other than the narrowest-angle curved part 10*d* are arranged in the lateral part 10*e*, which is between the narrowest-angle curved part 10*d* and the second connection part 10*b* of the upstream-side EGR pipe 10. Then, among the two curved parts 10*g* and 10*h* arranged in this lateral part 10*e*, the narrower angle curved part 10*h* is arranged on the side of the second connection part 10*b*.

In addition, the curved part 10*f* arranged between the narrowest-angle curved part 10*d* and first connection part 10*a* is arranged at a position at which the distance between the curved part 10*f* and the narrowest-angle curved part 10*d* is greater than the distance between the curved part 10*f* and the first connection part 10*a*. In addition, the two curved parts 10*g* and 10*h* arranged between the narrowest-angle curved part 10*d* and second connection 10*b* are arranged at positions at which the sum of the distances between the narrowest-angle curved part 10*d* and the respective curved parts 10*g* and 10*h* is greater than the sum of the distances between the second connection part 10*b* and the respective curved parts 10*g* and 10*h*. In other words, the three curved parts 10*f*, 10*g* and 10*h* other than the narrowest-angle curved part 10*d* are arranged to be near a side of the first connection part 10*a* or a side of the second connection part 10*b*.

It should be noted that it is sufficient so long as the curve angles of the curved parts 10*f*, 10*g* and 10*h* other than the narrowest-angle curved part 10*d* are curved at a wider angle than the curve angle of the narrowest-angle curved part 10*d*.

With the EGR device 8 equipped with the above configuration, the EGR gas that is a portion of the exhaust gas discharged from the internal combustion engine 1 is made to flow into the upstream-side EGR pipe 10 from the exhaust channel immediately after the catalytic converter 5, the EGR gas is made to cool by the EGR cooler 11, the flow rate of the EGR gas is adjusted by the EGR valve 12, and flows through the downstream-side EGR passage 13 to be recirculated to the intake manifold.

The following effects are thereby exerted by the EGR device 8 according to the present embodiment.

In other words, the upstream-side EGR pipe 10 extends upwards from the first connection part 10*a*, includes the four curved parts 10*d*, 10*f*, 10*g* and 10*h* between the first connection part 10*a* and second connection part 10*b*, and the narrowest-angle curved part 10*d* which is curved at the narrowest angle among the four curved parts 10*d*, 10*f*, 10*g* and 10*h* is arranged at a position at which a distance from the first connection part 10*a* (length of longitudinal part 10*c*) and a distance from the second connection part 10*b* (length of lateral part 10*e*) are almost equivalent.

Herein, if the catalytic converter 5 expands in the downward direction, which is the axis-line direction (longitudinal direction of catalytic converter 5) shown in FIG. 2B, due to heat input, a stress concentration will arise in the upstream-side EGR pipe 10 connected by the first connection part 10*a* with the exhaust channel immediately after the catalytic converter 5, at the first connection part 10*a* and second connection part 10*b*, particularly in the area of the first flange 10*a*1 and in the area of the second flange 10*b*1.

According to the present embodiment, since the narrowest-angle curved part 10*d* is arranged at a position at which the distance from the first connection part 10*a* (length of the longitudinal part 10*c*) and the distance from the second connection part 10*b* (length of the lateral part 10*e*) are almost equivalent, even if making the narrowest angle at a position farthest from the first connection part 10*a* and second connection part 10*b* and it is an upstream-side EGR pipe made from metal, the curve angle of the narrowest-angle curved part 10*d* is easily altered to easily disperse the stress concentration. The stress concentration arising in the area of the first flange 10*a*1 of the first connection part 10*a* and in the area of the second flange 10*b*1 of the second connection part 10*b* is thereby greatly dispersed by the narrowest-angle curved part 10*d*, and further, the stress concentration that has not been dispersed by the narrowest-angle curved part 10*d* is dispersed by the three curved parts 10*f*, 10*g* and 10*h* other than the narrowest-angle curved part 10*d*.

Therefore, with a simple configuration like providing the four of the curved parts 10*d*, 10*f*, 10*g* and 10*h* in the upstream-side EGR pipe 10, it is possible to cause the stress concentration acting on the EGR pipe 10 and the first connection part 10*a* and second connection part 10*b*, which are connection parts thereof, particularly in the area of the first flange 10*a*1 and in the area of the second flange 10*b*1, to be dispersed without increasing the number of components. For this reason, an increase in the production requirements, increase in costs and increase in weight of the EGR device 8 caused by the number of components increasing such as the conventional technology will not occur.

According to the present embodiment, since the upstream-side EGR pipe 10 slopes downwards from the second connection part 10*b* towards the first connection part 10*a*, it is possible to make discharge to the exhaust channel 6 without condensation water produced in the EGR cooler 11 and upstream-side EGR pipe 10 collecting in the upstream-side EGR pipe 10.

In the present embodiment, since the extending direction of the longitudinal part 10*c* from the first connection part 10*a* of the upstream-side EGR pipe 10 is a direction upwards from the first connection part 10*a* following the catalytic converter 5, despite the upstream-side EGR pipe 10 approaching the catalytic converter 5, since the upstream-side EGR pipe 10 is made from metal and is not something having components made from rubber or resin that are susceptible to heat, it is strong to heat damage and no problems arise. It is thereby possible to achieve optimization in the layout between the upstream-side EGR pipe 10 and other devices that cannot be arranged in the vicinity of the catalytic converter 5 having components made from rubber or resin that are susceptible to heat damage.

In the present embodiment, the four curved parts 10*d*, 10*f*, 10*g* and 10*h* are arranged more between the narrowest-angle curved part 10*d* and the second connection part 10*b* (lateral part 10*e*) than between the first connection part 10*a* and the narrowest-angle curved part 10*d* (longitudinal part 10*c*).

Herein, if the catalytic converter 5 expands in the downward direction, which is the axis-line direction (longitudinal direction of the catalytic converter 5) shown in FIG. 2A, due to heat input, the upstream-side EGR pipe 10 connected at the first connection part 10*a* with the exhaust channel immediately after the catalytic converter 5 is drawn to the first connection part 10*a* side and the stress concentration becomes greatest in the area of the second flange 10*b*1 of the second connection part 10*b*. According to the present embodiment, since the two curved parts 10*g* and 10*h* are arranged between the narrowest-angle curved part 10*d* and second connection part 10*b* of the upstream-side EGR pipe 10 (lateral part 10*e*), it is possible to make the stress concentration in the area of the second flange 10*b*1 of the second connection part 10*b*, at which the stress concentration reaches a maximum, to be dispersed.

In the present embodiment, the two curved parts 10*g* and 10*h* are arranged between the narrowest-angle curved part 10*d* and second connection part 10*b* (lateral part 10*e*), and the narrower curved part 10*h* is arranged at the second connection part 10*b* side.

Herein, if the catalytic converter 5 expands in the downward direction, which is the axis-line direction (longitudinal direction of the catalytic converter 5) shown in FIG. 2B, due to heat input, the upstream-side EGR pipe 10 connected at the first connection part 10*a* with the exhaust channel immediately after the catalytic converter 5 is drawn to the first connection part 10*a* side and the stress concentration becomes the greatest in the area of the second flange 10*b*1 of the second connection part 10*b*. According to the present embodiment, the narrower curved part 10*h* is arranged at the second connection part 10*b* side. For this reason, even if a pipe made from metal, the one of the curved parts having a narrower angle allows the stress concentration to be easily dispersed by varying the curve angle, and the curved part 10*h* having the narrower angle is close to the second connection part 10*b*; therefore, it is possible to disperse the stress concentration in the area of the second flange 10*b*1 of the second connection part 10*b* at which the stress concentration reaches a maximum.

In the present embodiment, the curved part 10*f* arranged between the narrowest-angle curved part 10*d* and the first connection part 10*a* (longitudinal part 10*c*) is arranged at a position at which the distance between the curved part 10*f* and the narrowest-angle curved part 10*d* is greater than the distance between the curved part 10*f* and the first connection part 10*a*. In addition, the two curved parts 10*g* and 10*h* arranged between the narrowest-angle curved part 10*d* and the second connection part 10*b* (lateral part 10*e*) are arranged at positions at which the sum of the distances between the narrowest-angle curved part 10*d* and the respective curved parts 10*g* and 10*h* is greater than the sum of distances between the second connection part 10*b* and the respective curved parts 10*g* and 10*h*. In other words, the three curved parts 10*f*, 10*g* and 10*h* other than the narrowest-angle curved part 10*d* are arranged to be near the first connection part 10*a* side or the second connection part 10*b* side.

Herein, if the catalytic converter 5 expands in the downward direction, which is the axis-line direction (longitudinal direction of the catalytic converter 5) shown in FIG. 2A, due to heat input, a stress concentration arises in the upstream-side EGR pipe 10 connected by the first connection part 10*a* with the exhaust channel immediately after the catalytic converter 5, in the area of the first flange 10*a*1 of the first connection part 10*a* and in the area of the second flange 10*b*1 of the second connection part 10*b*.

According to the present embodiment, the three curved parts 10*f*, 10*g* and 10*h* are arranged to be near the first connection part 10*a* side or the second connection part 10*b* side. For this reason, the three curved parts 10*f*, 10*g* and 10*h* other than the narrowest-angle curved part 10*d* being arranged to the first connection part 10*a* side or second connection part 10*b* side better disperses a stress concentration near the stress concentration location; therefore, it is possible to disperse a stress concentration arising in the area of the first flange 10*a*1 of the first connection part 10*a* and in the area of the second flange 10*b*1 of the second connection part 10*b*.

The present inventors conducted research for confirming the effects of the upstream-side EGR pipe 10 according to the present embodiment as described above.

Figure 5B:
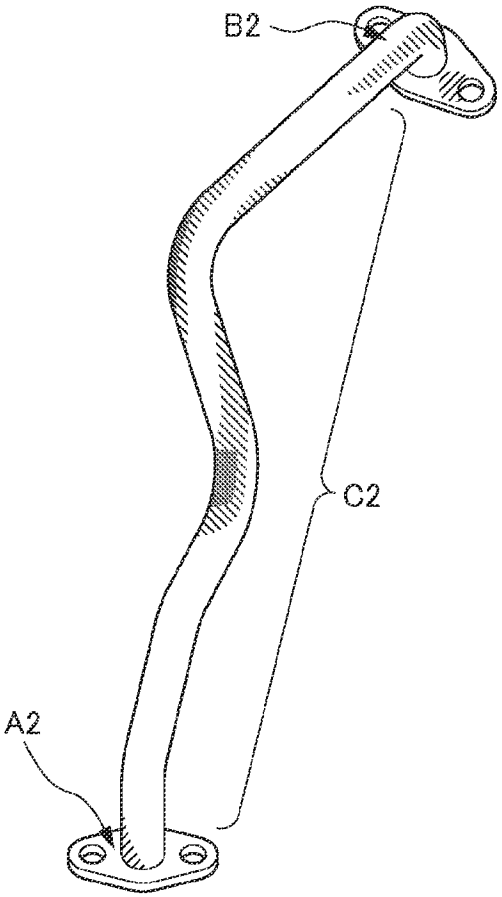
FIG. 5B is a view showing an upstream-side EGR pipe according to a comparative example.
Figure 5A:
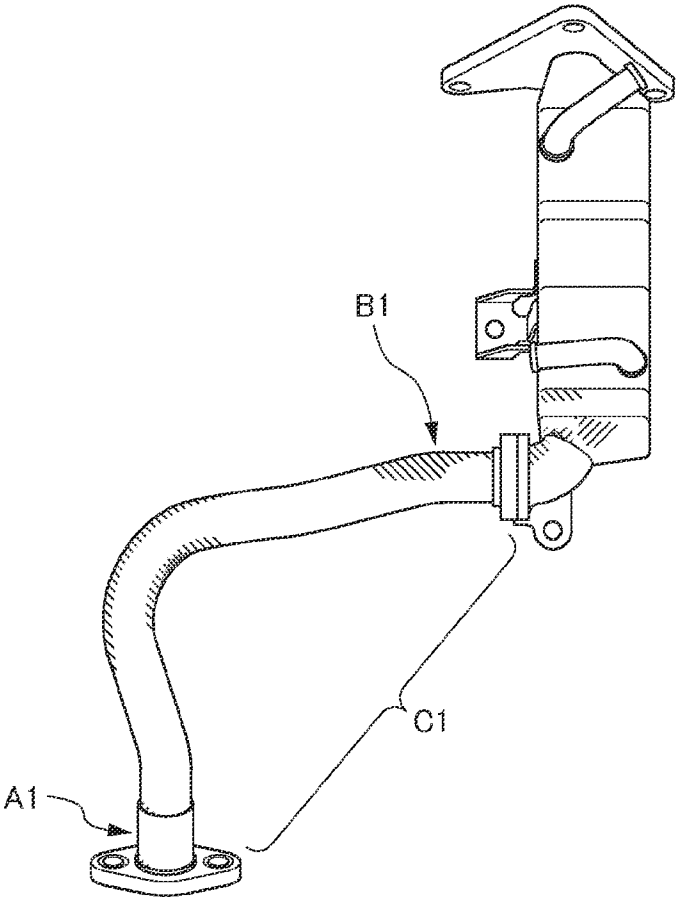
FIG. 5A is a view showing the upstream-side EGR pipe according to an example.

FIGS. 5A and 5B are views showing upstream-side EGR pipes according to an example and a comparative example, with FIG. 5A showing the upstream-side EGR pipe according to the example, and FIG. 5B showing the upstream-side EGR pipe according to the comparative example. The oblique-line parts on FIGS. 5A and 5B indicate positions of high stress.

The upstream-side EGR pipe according to the example shown in FIG. 5A adopts the upstream-side EGR pipe 10 according to the present embodiment, and thus is similar to the present embodiment. The upstream-side EGR pipe according to the comparative example shown in FIG. 5B has a plurality of curved parts, but does not have a narrowest-angle curved part like the upstream-side EGR pipe 10 according to the present embodiment.

Test Conditions: A tension load similar to the catalytic converter expanding in the axis-line direction (longitudinal direction of the catalytic converter) due to heat input was applied to both upstream-side EGR pipes of the example and comparative example.

Results: A stress A1 of the first connection part of the upstream-side EGR pipe of the example was 0.4 times compared to a stress A2 of the first connection part of the comparative example, and thus the stress concentration of the upstream-side EGR pipe according to the example was reduced.

A stress B1 of the second connection part of the upstream-side EGR pipe of the example was 0.7 times compared to a stress B2 of the second connection part of the comparative example, and thus the stress concentration of the upstream-side EGR pipe according to the example was reduced.

In the overall upstream-side EGR pipe, an overall stress C1 of the example was 0.5 times compared to an overall stress C2 of the comparative example, and thus the stress concentration of the upstream-side EGR pipe according to the example was reduced.

The effects of the upstream-side EGR pipe according to the present embodiment could thereby be confirmed.

It should be noted that the present invention is not to be limited to the aforementioned embodiment, and that various modifications thereto are possible.

For example, with the above-mentioned embodiment, the plurality of curved parts are four including the narrowest-angle curved part; however, it is sufficient so long as the plurality of curved parts in the present invention are two or more including the narrowest-angle curved part.

In addition, with the above-mentioned embodiment, the upstream-side EGR pipe is extended upwards from the first connection part, and stretches in the horizontal direction through the narrowest-angle curved part; however, the EGR pipe of the present invention may be extended from the first connection part in a substantially horizontal direction at the second connection part side, and stretch substantially upwards through the narrowest-angle curved part.

In addition, in the above-mentioned embodiment, two curved parts are arranged between the narrowest-angle curved part and the second connection part, and the narrower-angle curved part is arranged to the second connection part side; however, in the present invention, in the case of two or more curved parts being arranged between the narrowest-angle curved part and the first connection part, the narrower-angle curved part may be arranged to the first connection part side.

In addition, in the above-mentioned embodiment, two curved parts are arranged between the narrowest-angle curved part and the second connection part, and are arranged at positions so that the sum of the distances between the narrowest-angle curved part and the respective curved parts is greater than the sum of distances between the second connection part and the respective curved parts; however, in the present invention, in the case of two or more curved parts being arranged between the narrowest-angle curved part and the first connection part, they may be arranged at positions so that the sum of distances between the narrowest-angle curved part and the respective curved parts is greater than the sum of distances between the first connection part and the respective curved parts.

The invention claimed is:

1. An exhaust gas recirculation device for an internal combustion engine, comprising an EGR pipe for recirculating exhaust gas to an intake channel from an exhaust channel immediately after an exhaust gas purification device provided midstream of the exhaust channel in the vicinity of a cylinder block of the internal combustion engine, wherein:

a first connection part that connects the exhaust channel immediately after the exhaust gas purification device and the EGR pipe is provided to an upstream side of the EGR pipe;

a second connection part that connects the EGR pipe with a device or another pipe leading to the intake channel is provided above the first connection part to a downstream side of the EGR pipe;

the exhaust gas purification device expands in a longitudinal direction due to heat input, and as a result, the second connection part has stress concentration higher than the first connection part;

the EGR pipe extends substantially upwards in a longitudinal direction from the first connection part or extends in a substantially horizontal direction at a side of the second connection part, and has a plurality of curved parts between the first connection part and the second connection part;

a narrowest-angle curved part is a single part that is curved at the narrowest angle among the plurality of curved parts is disposed at a position at which a distance from the first connection part and a distance from the second connection part are substantially equal, and wherein the narrowest-angle curved part is provided between a part of the EGR pipe that extends substantially upwards in the longitudinal direction from the first connection part, and a part of the EGR pipe that extends substantially horizontally from the second connection part; and a number of curved parts disposed between the narrowest-angle curved part and the second connection part is greater than a number of the curved parts disposed between the first connection part and the narrowest-angle curved part, wherein the curved parts bend so as to disperse the stress concentration from the second connection part.

2. An exhaust gas recirculation device for an internal combustion engine according to claim 1, wherein two or more of the curved parts are disposed between the narrowest-angle curved part and the first connection part or the second connection part, and a curved part having a narrower angle is disposed to a side of the first connection part or a side of the second connection part.

3. An exhaust gas recirculation device for an internal combustion engine according to claim 1, wherein at least one or more of the curved parts is disposed between the narrowest-angle curved part and the first connection part or the second connection part, and in a case of one being disposed, the curved part is disposed at a location at which a distance between the curved part and the narrowest-angle curved part is greater than a distance between the curved part and the first connection part or the second connection part, and in a case of two or more being disposed, the curved parts are disposed at locations at which a sum of distances between the narrowest-angle curved part and the respective curved parts is greater than a sum of distances between the first connection part or the second connection part and the respective curved parts.

4. An exhaust gas recirculation device for an internal combustion engine according to claim 1, wherein:

the second connection part connects the EGR pipe and an EGR cooler that cools EGR gas having passed through the EGR pipe; and the EGR pipe slopes downwards from the second connection part towards the first connection part.

5. An exhaust gas recirculation device for an internal combustion engine according to claim 1, wherein an extending direction of the EGR pipe from the first connection part is a substantially upwards direction from the first connection part following the exhaust gas purification device.

6. The exhaust gas recirculation device for an internal combustion engine according to claim 1, wherein the narrowest-angle curved part is curved in the vicinity of 90 degrees.

7. The exhaust gas recirculation device for an internal combustion engine according to claim 1, wherein the EGR pipe is connected on the upstream side to an EGR cooler.

* * * * *